US005375526A

United States Patent [19]

Hoffmann

[11] Patent Number: 5,375,526

[45] Date of Patent: Dec. 27, 1994

[54] FUZE MECHANISM FOR PROJECTILES, ROCKETS, BOMBLETS AND MINES HAVING A PYROTECHNIC SELF-DESTRUCT MECHANISM

[75] Inventor: Wolfgang Hoffmann, Velbert, Germany

[73] Assignee: Rheinmetall GmbH, Ratingen, Germany

[21] Appl. No.: 190,379

[22] Filed: Feb. 2, 1994

[30] Foreign Application Priority Data

Feb. 4, 1993 [DE] Germany ..... 4303128

[51] Int. Cl.[5] ..... F42C 9/16; F42C 15/22

[52] U.S. Cl. ..... 102/269; 102/226; 102/227

[58] Field of Search ..... 102/226, 227, 228, 229, 102/256, 266, 269

[56] References Cited

U.S. PATENT DOCUMENTS

| | | | |
|---|---|---|---|
| 3,371,608 | 3/1965 | Webb | 102/269 |
| 4,612,858 | 9/1986 | Backstein et al. | 102/245 |
| 4,811,664 | 3/1989 | Levy et al. | 102/226 |
| 4,901,643 | 2/1990 | Rudenauer et al. | 102/256 |
| 5,022,325 | 6/1991 | Skowasch et al. | 102/226 |
| 5,275,101 | 1/1994 | Chemiere et al. | 102/269 |

FOREIGN PATENT DOCUMENTS 0411996 2/1991 European Pat. Off. .

*Primary Examiner*—David Brown

*Attorney, Agent, or Firm*—Spencer, Frank & Schneider

[57] ABSTRACT

A fuze mechanism (1) for projectiles, rockets, bomblets and mines which is of the type including a fuze housing (2) and a self-destruct device containing a pyrotechnic delay arrangement (10) and a firing pin (11), with the fuze housing (2) having a side opening (5) for a transversely movable detonator carrier (4) which can be moved out beyond the outer housing contour into the armed position and which contains the pyrotechnic delay arrangement (10) and a fuze detonator (7). To manufacture fuze mechanisms (1) which are simple and free of spin and whose self-destruct devices are additionally provided with a delay time that is as long as possible, the firing pin (11) for the self-destruct mechanism is pivotably fastened to the fuze housing (2) in the region of the side opening (5). Moreover, the detonator carrier (4), on its side facing the opening (5), is provided with a carrier member (12) which is in force-locking contact with the firing pin (11) and which, when the detonator carrier (4) is moved out, pivots the firing pin (11) toward the delay arrangement (10) so that the same is ignited.

10 Claims, 1 Drawing Sheet

FUZE MECHANISM FOR PROJECTILES, ROCKETS, BOMBLETS AND MINES HAVING A PYROTECHNIC SELF-DESTRUCT MECHANISM

BACKGROUND OF THE INVENTION

The invention relates to a fuze mechanism for projectiles, rockets, bomblets and mines having a pyrotechnical delay device and a self-destruct device containing a firing pin. More particularly, the present invention relates to a fuze mechanism of the type having a fuze housing and a self-destruct device containing a pyrotechnical delay arrangement and a firing pin, with the fuze housing having a side opening for a transversely movable detonator carrier which can be moved out beyond the outer housing contour into the ignition position for the fuze and which contains the pyrotechnical delay arrangement and the fuze detonator.

These types of fuze mechanisms normally ignite upon impact of the projectile, etc., on a target. If the target medium is very soft, for example, snow, bushes or the axis of the projectile is angled sharply in relation to the trajectory, the impact impulse frequently no longer suffices for an ignition. In order to destroy these dud shells which are armed and therefore dangerous, the fuze mechanism is provided with a self-destruct mechanism including a delay device in addition to a detonator for impact initiation. The delay time in this case must be longer than the flight time of the projectiles, etc., so that self-destruct does not occur until after a possible ignition failure upon impact. Both the detonator for the impact initiation and the delay device of the self-destruct device are arranged in a slider (detonator carrier) which is arranged to be transversely displaceable relative to the longitudinal axis of the projectile.

German laid open patent application No. DE 3,740,967 A1, corresponding to U.S. Pat. No. 4,901,643, discloses a fuze of this type including a self-destruct device, which is arranged telescopically in the detonator carrier. In addition to the pyrotechnic delay device, the self-destruct device is provided with a firing pin which, in relation to the delay device, is arranged stationarily on the detonator carrier.

Subsequent to launching such a projectile, etc., which is provided with the prior art fuze, centrifugal forces and/or a spring move the detonator carrier outward through a side opening in the fuze housing. This causes the detonator, which is arranged in the detonator carrier, to be pushed under a striking pin, so that this striking pin, as a ruled strikes the detonator and ignites the projectile during impact of the projectile on a target.

The centrifugal and spring forces simultaneously cause the portion of the detonator carrier containing the delay device to strike against the firing pin of the self-destruct device in the transverse direction and the detonator to ignite, after a predetermined burning time of the delay device, if ignition does not occur upon impact on the target.

A drawback of this known fuze mechanism is primarily the relatively great expense caused by the production of the detonator carrier including the additional telescoping delay mechanism.

U.S. Pat. No. 4,811,664 also discloses a bomblet ignitor with a pyrotechnic self-destruct device in which the firing pin is pivotably arranged at the end of the detonator carrier. As soon as the detonator carrier is displaced outwardly and has reached its end position, the pin swings in the direction of the delay device and ignites the same.

The drawback of this ignition device is primarily that the rotational axis of the firing pin must be located just ahead of the plane in which the detonator composition of the delay device is located, so that the firing pin pierces the delay mechanism perpendicularly. It is therefore not possible to utilize the full diameter of the fuze housing for the length of the delay device. Moreover, the piercing speed in this fuze is relatively low, for projectiles which are fired without spin, so that ignition problems may arise in connection with the relatively small quantity of firing pin material.

SUMMARY OF THE INVENTION

It is the object of the present invention to provide an ignition device that is simply constructed, guaranteed to function, and includes a pyrotechnic self-destruct device, which has a longer delay time than prior art devices having pivotable firing pins, and in which the delay device is reliably activated even in the absence of spin.

The object generally is attained according to the invention by a fuze mechanism for projectiles, rockets, bomblets and mines, of the type which comprises: a fuze housing having a side opening; a detonator carrier containing a fuze detonator and a pyrotechnic delay arrangement of a self-destruct device, with the detonator carrier being mounted within the housing for movement transverse to a longitudinal axis of the housing between a safety position, wherein the carrier is within the housing and the detonator is not in a position to be detonated, and an armed position wherein the detonator is in a position to be detonated and one end of the carrier extends through the side opening of the housing out beyond an outer contour of the housing; and a firing pin for the self-destruct device for igniting the pyrotechnic delay arrangement of the self-destruct device when the detonator carrier is in the armed position; and wherein: the firing pin is pivotally fastened to the fuze housing in the region of the side opening for pivoting movement toward the pyrotechnic delay arrangement; and the detonator carrier is provided, on its side facing the side opening, with a carrier member which is in force-locking contact with the firing pin during movement of the carrier member from the safety to the ignition position to pivot the firing pin toward the pyrotechnic delay arrangement to ignite same.

According to further particularly advantageous modifications of the invention, the detonator carrier is provided with a groove-like recess which is disposed between the portion of the detonator carrier containing the pyrotechnic delay arrangement and the carrier member, and in which the firing pin is form-lockingly arrested when the detonator carrier is in the ignition position.

The invention is therefore essentially based on the concept of pivotably fastening the firing pin of the self-destruct device to the fuze housing and to cause the firing pin to be positioned in the ignition position by means of the detonator carrier.

The firing pin is preferably arrested in a form-lock with the detonator carrier.

Further details and advantages of the invention become clear from the description of the embodiments which are described below with the help of the Figures.

DETAILED DESCRIPTION OF THE PREFERRED EMBODIMENT

Figure 1:
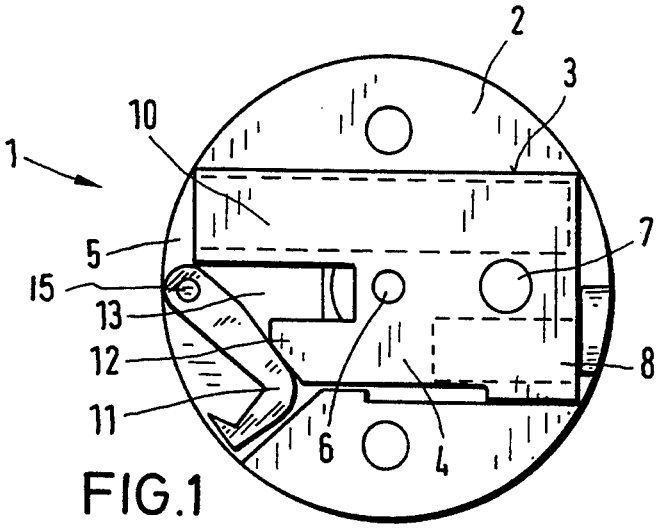
FIG. 1 is a schematic cross-sectional view of the fuze housing of a bomblet including a secured detonator carrier and a self destruct mechanism firing pin pivoted into the housing according to the invention.

FIG. 1 shows a fuze mechanism 1 according to the invention for a bomblet in the safety position. The fuze mechanism 1 comprises essentially a fuze housing 2 having a transversely extended recess 3 in which a detonator carrier or slider 4 is slideably arranged. The fuze housing 2 is provided, in a known manner, with a side opening 5 through which the detonator carrier 4 can be pushed at least partially (See, for example, German laid open Patent Application DE 3,333,312 A1 and corresponding U.S. Pat. No. 4,612,858).

An empty bore 6, which is engaged by the tip of a non-illustrated striking pin (which is generally disposed along the longitudinal axis 14 of the fuze housing 2) of the impact fuze, and the appropriate detonator 7 are both located in detonator carrier 4, but laterally spaced from one another along a common cross sectional axis. During the eject%ion of the bomblet from a carrier projectile, the striking pin (not shown) for the impact fuze is lifted from the empty bore 6, for example, by means of a stabilizing band. Then a spring 9, which is located in a blind hole 8 of the detonator carrier 4, moves the detonator carrier 4 outwardly into the armed position for the impact fuze. This is accomplished when the detonator carrier has moved laterally so that the tip of the striking pin is above the detonator 7 as shown for example in FIG. 3.

The detonator carrier 4 further contains a pyrotechnic delay arrangement 10, which commonly comprises a (not separately illustrated) detonator composition and delay composition. The delay composition ends in the vicinity of fuze detonator 7.

Figure 3:
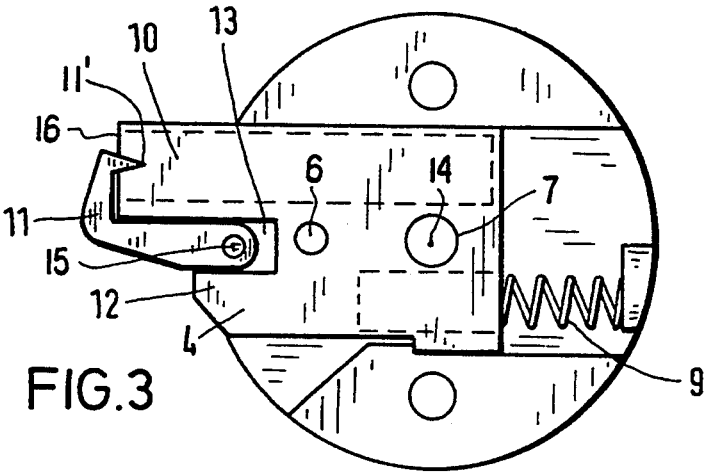
FIG. 3 shows the fuze housing of FIG. 1 in the armed position of the fuze with the carrier movement arrested and the self destruct mechanism pierced by the firing pin.

The fuze mechanism 1 according to the invention is provided in the region of its side opening 5 with a firing pin 11 which is pivotally fastened on the fuze housing 2 for pivotal movement about a pivot axis 15, which is generally parallel to the housing longitudinal axis 14. The detonator carrier 4 is additionally provided with a carrier member 12 which is laterally shorter than the portion of carrier 4 containing the delay arrangement 10, which contacts the firing pin 11 in a force locking manner and which pivots the firing pin 11 toward the ignition composition of pyrotechnic delay arrangement 10 so as to ignite it when the carrier 10 is in the armed position as shown in FIG. 3. The firing pin 11 preferably has a "J" shape as shown so that the piercing point 11' pierces the end surface 16 of the carrier 4.

A groove-shaped recess 13 is provided between the portion of the detonator carrier 4 containing the pyrotechnic delay arrangement 10 and the carrier member 12. The firing pin 11 is form-lockingly arrested in this recess 13 when the carrier 4 is in the firing or armed position as shown in FIG. 3. For this purpose, the pivot axis 15 for the firing pin 11 is disposed in the path of movement of the recess 13 which extends from the end surface 16 of the carrier 4 and which extends substantially along a cross-sectional axis of the carrier.

The function of the fuze according to the invention is described in detail below:

The fuze mechanism 1 is initially assumed to be in secured or safety position (FIG. 1). Then the detonator carrier 4 is arranged entirely in the interior of the fuze housing 2 such that the striking pin (not illustrated) is either in the empty bore 6 or aligned with but above the same. The firing pin 11 of the self-destruct device is also pivoted into the fuze housing 2 and is held there by a suitable safety member (not shown).

Figure 2:
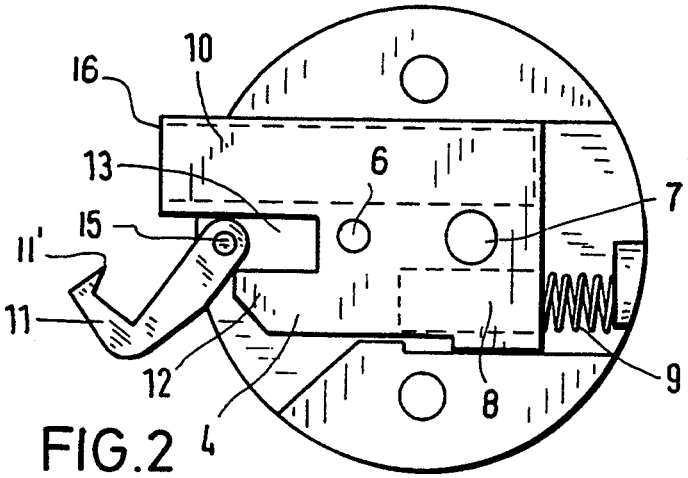
FIG. 2 shows the fuze housing of FIG. 1 subsequent to initiation is the movement of the detonator carrier to arm the fuze and during movement of the carrier through the side opening of the housing.

After the fuze mechanism 1 is armed (for example, after ejection of the bomblet from the carrier projectile, etc.) one end of the detonator carrier 4 is moved out of the fuze housing 2 by means of the pressure spring 9 (and/or the centrifugal force, if a spin projectile is involved) transverse to the longitudinal axis 14 of the bomblet (FIG. 2). In this case, the slider 4, and more specifically the carrier member 12 presses against the pivotable firing pin 11 and pivots it into the piercing position as shown in FIG. 3.

In the piercing position (FIG. 3), the firing pin 11 is form-lockingly arrested by the groove-shaped recess 13 in slider 4. Only after this, the slider 4 reaches the firing position (the striking pin is flush longitudinally with, and above detonator 7), and the ignition composition of the pyrotechnical delay arrangement 10 is pressed onto the point 11' of the firing pin 11.

It will be understood that the above description of the present invention is susceptible to various modifications, changes and adaptations, and the same are intended to be comprehended within the meaning and range of equivalents of the appended claims.

What is claimed is:

1. In a fuze mechanism for projectiles, rockets, bomblets and mines, with said fuze mechanism comprising: a fuze housing having a side opening; a detonator carrier containing a fuze detonator and a pyrotechnic delay arrangement of a self-destruct device, said detonator carrier being mounted within said housing for movement transverse to a longitudinal axis of said housing between a first safety position, wherein said carrier is within said housing and said detonator is not in a position to be detonated, and a second armed position wherein said detonator is in a position to be detonated and one end of said carrier extends through said side opening of said housing out beyond an outer contour of said housing; and a firing pin for said self-destruct device for igniting said pyrotechnic delay arrangement of said self-destruct device when said detonator carrier is in said armed position; the improvement wherein: said firing pin is pivotally fastened to said fuze housing in the region of said side opening for pivoting movement toward said pyrotechnic delay arrangement; and said detonator carrier is provided, on its side facing said side opening, with a carrier member which is in force-locking contact with said firing pin during movement of said carrier member from said first to said second position to pivot said firing pin toward said pyrotechnic delay arrangement to ignite same.

2. A fuze device according to claim 1, wherein said detonator carrier is provided with a groove-like recess which is disposed between the portion of said detonator carrier containing said pyrotechnic delay arrangement and said carrier member and in which said firing pin is form-lockingly arrested when said detonator carrier is in said ignition position.

3. A fuze device according to claim 2, wherein: said groove-like recess extends from an end surface at said one end of said detonator carrier transverse to said longitudinal axis of said fuze housing; and said firing pin is pivotally mounted on said housing for movement about a pivot axis which is parallel to said longitudinal axis of said housing and which is disposed in the path of movement of said groove-like recess.

4. A fuze device according to claim 3, wherein said pivot axis and said groove-like recess are disposed substantially along a cross-sectional axis of said fuze housing.

5. A fuze device according to claim 3, wherein said firing pin is disposed entirely within said fuze housing when said detonator carrier is in said safety position.

6. A fuze device according to claim 5, wherein said carrier member does not extend to said end surface of said one end of said carrier.

7. A fuze device according to claim 5, wherein said firing pin has a substantially J-shape and pierces said end surface of said carrier to ignite said pyrotechnic delay arrangement when said carrier is in said armed position.

8. A fuze device according to claim 7, wherein said carrier member does not extend to said end surface of said one end of said carrier.

9. A fuze device according to claim 7, wherein said pivot axis and said groove-like recess are disposed substantially along a cross-sectional axis of said fuze housing.

10. A fuze device according to claim 9, wherein said carrier member does not extend to said end surface of said one end of said carrier.

* * * * *